United States Patent [19]

Lee

[11] Patent Number: 4,846,438

[45] Date of Patent: Jul. 11, 1989

[54] MOLDING DEVICE WITH HAND OPERABLE MOLD

[76] Inventor: Yuan-Ho Lee, No. 851, Chung-San Rd., Nan-Pao Tsun, Kuei-Jen Hsian, Tainan Hsieng, Taiwan

[21] Appl. No.: 175,986

[22] Filed: Mar. 31, 1988

[51] Int. Cl.[4] ..... B28B 7/22

[52] U.S. Cl. ..... 249/26; 249/27; 249/161; 249/162; 249/163; 249/189; 249/194; 249/207; 425/451.3

[58] Field of Search ..... 249/27, 26, 66 A, 66 C, 249/161, 162, 178, 189, 207, 146, 66 R, 63, 155, 193, 196, 181, 182; 425/451.3; 211/189, 195, 201; 411/89

[56] References Cited

U.S. PATENT DOCUMENTS

| | | | |
|---|---|---|---|
| 899,517 | 9/1908 | Edwards | 249/162 |
| 1,041,731 | 10/1912 | Bragstäd | 249/162 |
| 1,118,540 | 11/1914 | Ellingson | 249/162 |
| 1,198,645 | 9/1916 | Loxterman | 249/182 |
| 3,844,526 | 10/1974 | McCracken | 249/152 |
| 3,934,808 | 1/1976 | Aizawa | 249/27 |
| 3,999,736 | 12/1976 | Theodorsen | 249/91 |
| 4,252,291 | 2/1981 | Armas | 249/27 |
| 4,614,326 | 9/1986 | Strickland et al. | 249/180 |
| 4,667,923 | 5/1987 | Lee | 249/19 |
| 4,679,762 | 7/1987 | Lee | 249/26 |

FOREIGN PATENT DOCUMENTS

| | | | |
|---|---|---|---|
| 1028482 | 3/1978 | Canada | 249/162 |
| 2443442 | 4/1975 | Fed. Rep. of Germany | 249/162 |
| 473004 | 9/1975 | U.S.S.R. | 249/27 |

*Primary Examiner*—Jay H. Woo
*Assistant Examiner*—Khanh P. Nguyen
*Attorney, Agent, or Firm*—Sughrue, Mion, Zinn, Macpeak and Seas

[57] ABSTRACT

A molding device includes at least two comonent form boards 12,13 and a wedge-shaped spacer board 14 between them. An operating mechanism is associated with the form boards and the spacer, and moves them relative to one another. The operating mechanism includes at least one rack member 18, and at least one lever 26 connected with a pawl which swings about an axis eccentric with the axis of the lever. The pawl 28 engages with the rack and moves the rack forward when the lever is operated.

6 Claims, 5 Drawing Sheets

MOLDING DEVICE WITH HAND OPERABLE MOLD

BACKGROUND OF THE INVENTION

This invention relates to a molding device for concrete construction which can be released easily from a formed concrete structure and easily reset at another location for a next molding.

It is known in the art to provide molding devices which can be collapsed or contracted to be released from a formed concrete structure and which can be stretched to a molding position. Various types of collapsible molding devices have been suggested in the art. For example, U.S. Pat. Nos. 2,544,297, 3,614,054, 3,934,808 and French Pat. No. 2489206 disclose inner formwork boards used to form inner sides of multi-sided concrete walls. These formwork boards incorporate hydraulically operated linkage mechanisms which hold and operate the formwork boards. U.S. Pat. No. 4,679,762 of the inventor of this application discloses a form assembly which is used to form an enclosed multi-sided wall as shown in FIG. 1 and includes component boards and wedge-shaped spacer boards which are operated by a rack-and-gear mechanism including a plurality of worm wheels mounted on vertical shafts and horizontal shafts to drive rack members. To release this form assembly, the spacer boards must be moved inward simultaneously. When the spacer boards are moved, the form boards on two sides of the spacer boards also move simultaneously so that a great deal of force is needed to simultaneously release the entire form assembly. Accordingly, a powerful hydraulic device is necessary for operation. Moreover, this form assembly is suitable only for forming enclosed multi-sided walls.

SUMMARY OF THE INVENTION

An object of the invention is to provide a molding device which has a simple construction and which can be operated easily and with less power than that required by the prior form assemblies.

Another object of the invention is to provide a molding device for forming an enclosed multi-sided wall which can be released in part from the formed wall.

Still another object of the invention is to provide a molding device which can easily be manually removed from the formed structure.

According to the present invention, a molding device comprises: a first component form board having a first forming face and a first end face connected to the first forming face and forming an acute angle with a line, normal to the first forming face; a second component form board having a second forming face and a second end face connected to the second forming face and forming an acute angle with a line normal to the second forming face, the second end face being abutted with and releaseably connected to the first end face; means for releaseably connecting the first and second component form boards; and an operating unit associated with the first and second form boards and being operable to move said first and second form boards relative to one another, the unit including a rack member mounted on the first form board, a lever mounted on the second form board for turning about a horizontal axis adjacent to the rack member, a pawl member connected with the lever to swing about a horizontal axis which is eccentric with respect to the axis of the lever, the pawl member engaging with the rack member and displacing the rack member when the lever is operated.

In one aspect of the invention, the molding device includes a wedge-shaped spacer board placed between the two form boards, and the operating means moves the spacer board relative to each of the form boards.

In another aspect of the invention, the operating unit further includes a mounting seat mounted on each component board, and having at least one mounting hole, the lever having a shaft removably inserted in the mounting hole and an elongated handle connected to the shaft for turning the shaft, the operating unit further having an eccentric member fixed to the shaft, the pawl member having one end rotatably sleeved around the eccentric member.

The rack member includes a thick plate member having a top surface with rack teeth formed thereon and an upward edge flange thereon, the spacer board having an accommodating recess for removably receiving the rack member so as to change the position of the rack member as desired. The pawl member has a free end which has two opposite edge teeth either of which can engage with the rack teeth.

The exemplary preferred embodiment will be described in detail with reference to the accompanying drawings, in which:

DETAILED DESCRIPTION OF THE PREFERRED EMBODIMENT

Figure 2:
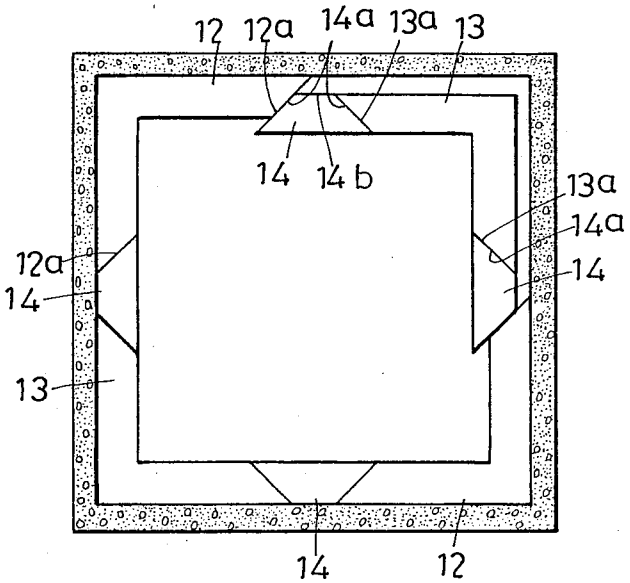
FIG. 2 is a schematic plan view showing a molding device of the present invention.
Figure 1:
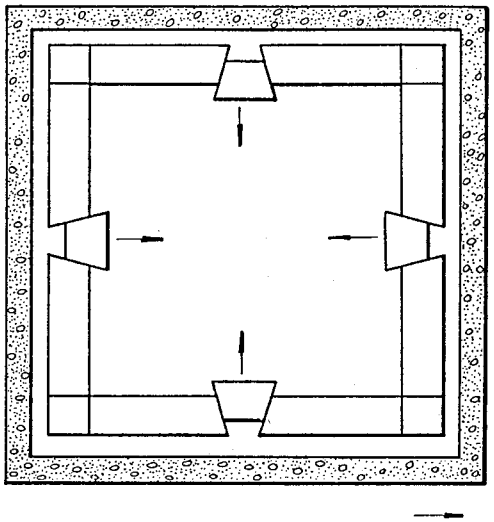
FIG. 1 (PRIOR ART)
FIG. 1 is a schematic plan view showing the operation of a form assembly of the prior art.
Figure 3:
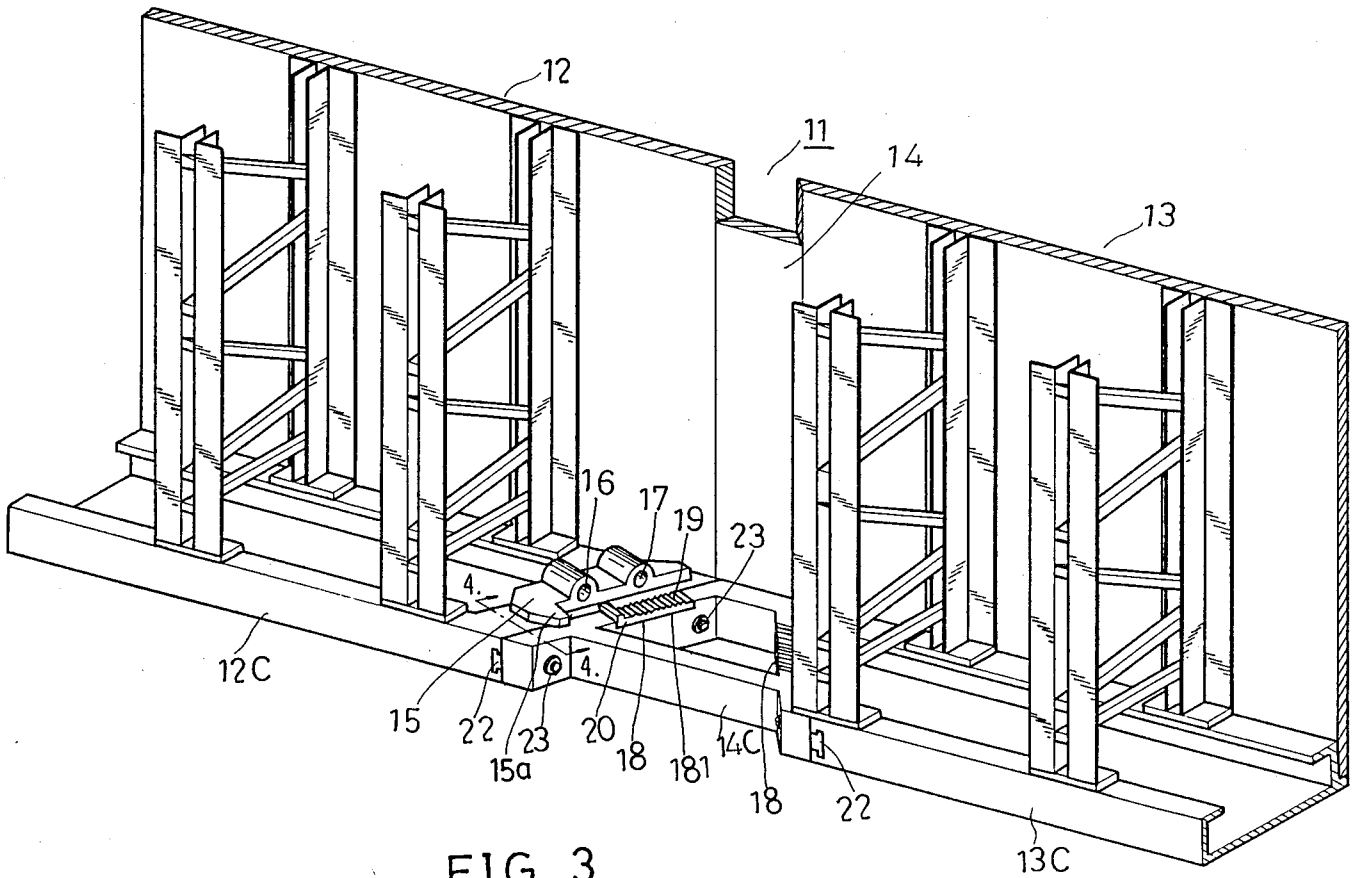
FIG. 3 is a fragmentary perspective view of the molding device of FIG. 2.
Figure 4:
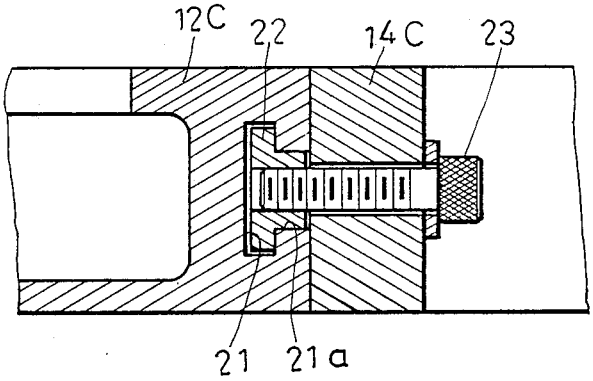
FIG. 4 is a fragmentary sectional view taken along line 4—4 of FIG. 3.

Referring to FIGS. 2 and 3, a molding device 11 for molding an inner side of a four-sided wall is shown, including two angled component form boards 12, two angled component form boards 13 and four spacer boards 14 which are interconnected to establish a four-sided forming face for a four wall room. Each spacer board 14 has a wedge-shaped cross-section and two diverging end faces 14*a* extending from a forming face 14*b* of the spacer board 14. Each form board 12 has two inclined end faces 12*a* abutting with and connected releaseably to adjacent end faces 14*a* of the spacer board 14. Also, each form board 13 has two inclined end faces 13*a* abutting with and connected releaseably to adjacent end faces 14*a* of the spacer board 14. Support bases 12*c*, 13*c* and 14*c* are disposed respectively at the bottom sides of the form boards 12 and 13 and the spacer boards 14. Referring to FIG. 4 in combination with FIG. 3, each slanted side of the base 12*c* or 13*c* is provided with an elongated groove 21 which has a restricted elongated opening 21*a* and receives an elongated bar 22 in a slideable position. Each bar 22 is connected through screws 23 to one side of the base 14*c* of each spacer board 14. The bar 22 can be prevented from moving in the groove 21 by tightening the screws 23, thereby securing together the spacer board 14 and the adjacent form board 12 and 13.

Figure 5:
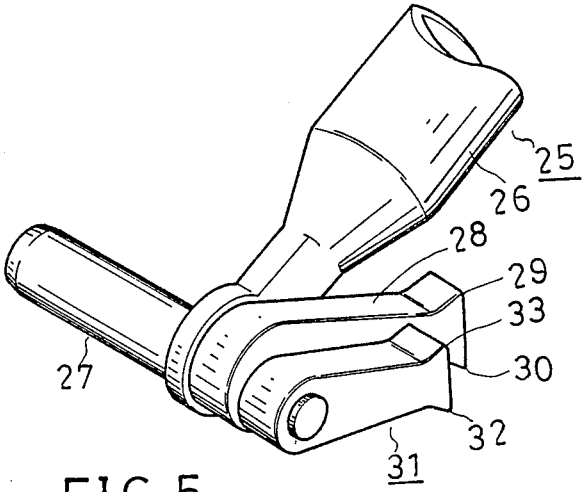
FIG. 5 is a perspective view of an operating mechanism of the present invention.
Figure 6:
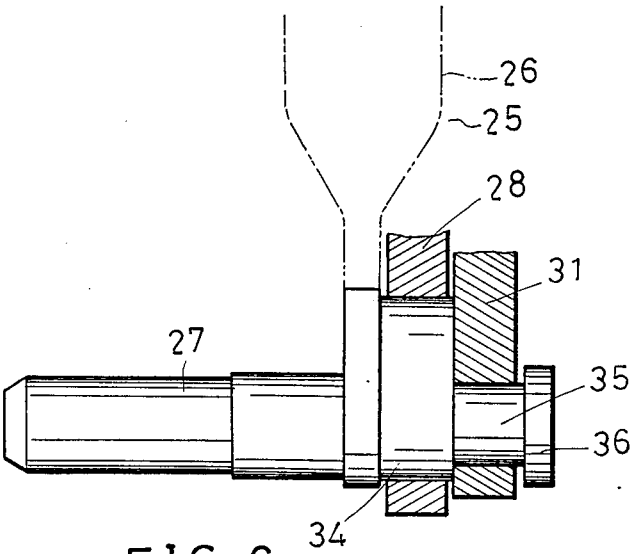
FIG. 6 is a sectional view of the operating mechanism of FIG. 5.

On the base 14*c* of each spacer board 14 are mounted two rack members 18 near the end faces of the spacer board 14. Each rack member 18 is a thick plate which is provided with teeth 19 at the top surface thereof and an upward stop edge flange 20. The rack member 18 is attached removably to the base 14*c*. The removable attachment may be accomplished by placing the rack member in a recess 181 of the base 14*c*. Referring to FIGS. 5 and 6 in combination with FIG. 3, an operating means 25 is mounted through a mounting seat 15 on one side of each base 12*c* or 13*c* adjacent to each rack member 18. The mounting seat 15 includes two raised parts provided respectively with outer and inner journal holes 16 and 17 and a stop projection 15*a*. The stop projection 15*a* is used to engage with the stop flange 20 of the rack member so as to stop the movement of the rack member.

Referring to FIGS. 5 and 6, an operating means 25, to operably associate with the rack member, includes a lever 26 connected to an operating shaft 27 which can be inserted changeably in two mounting holes 16 and 17. An eccentric member 34 is mounted on the shaft 27 adjacent to the lever 26. A pawl member 28 is sleeved with one end thereof rotatably around the eccentric member 34. The free end of the pawl member 28 has two opposed edge teeth 29 and 30. Adjacent to the eccentric member 34 is another pawl member 31 which is mounted on an end portion 35 of the shaft 27 to swing thereabout and which is prevented from escaping by means of a locking screw 36. The pawl also has two opposed edge teeth 32 and 33. By operating the levers 26, the spacer boards 14 can be moved relative to the adjacent form boards 12 or 13.

Figure 10:
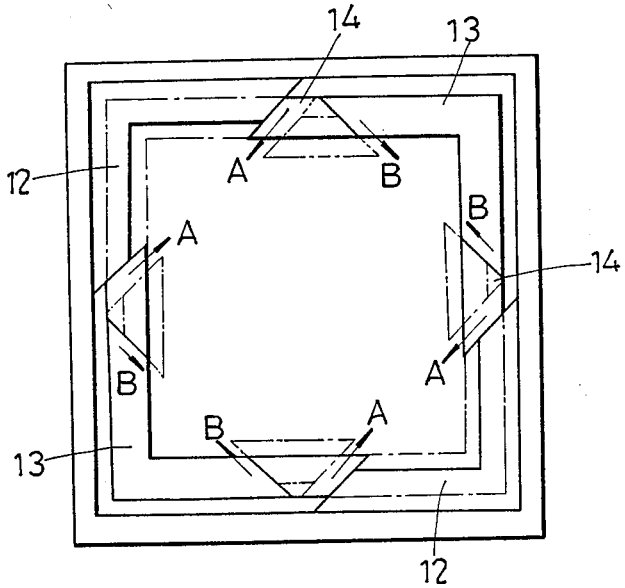
FIG. 10 shows the operation of releasing the molding device from the formed structure.

The operation of releasing the form of the invention is illustrated in FIG. 10. Firstly, the two form boards 13 are moved inwardly by operating the levers 26 so as to move the spacer boards 14 in the directions shown by arrow A relative to the form boards 12. Then, the form boards 12 are moved in the directions shown by arrow B by moving inward the spacer boards 14 inwardly relative to the form boards 13. The movement of the two form boards 12 or 13 can be effected either simultaneously or successively.

Figure 7:
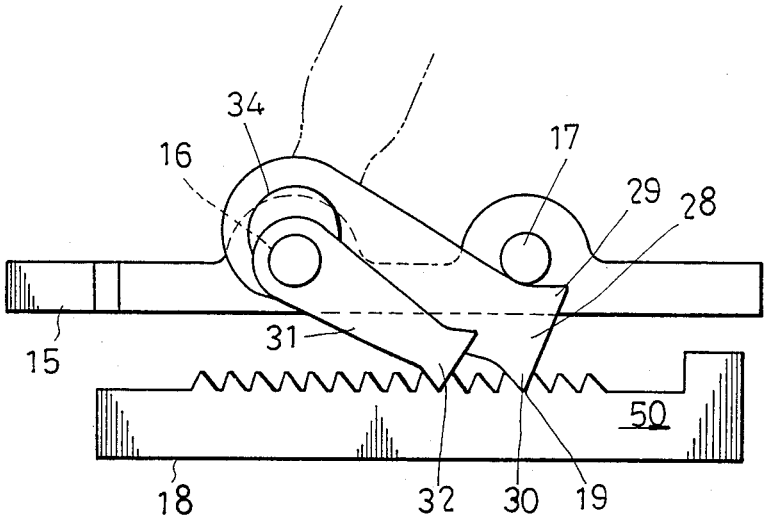
FIGS. 7 and 8 show the operations of the operating mechanism of FIG. 5.
Figure 8:
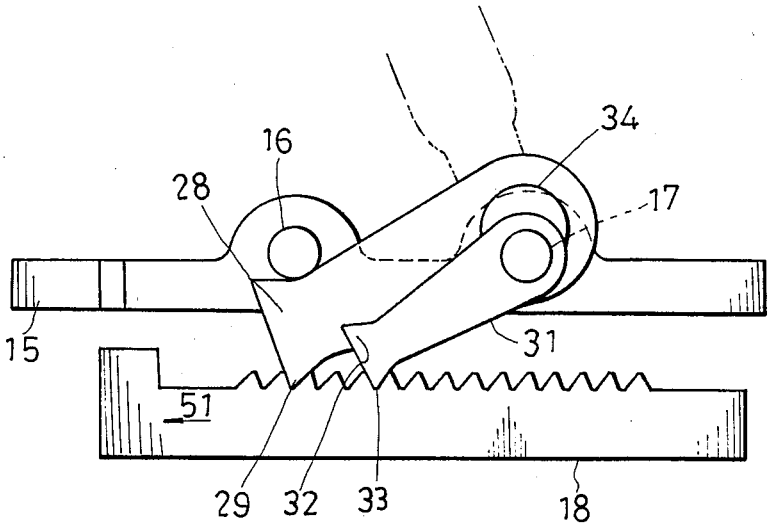

The operation of the operating means of the invention is shown in FIGS. 7 and 8. When the spacer board 14 is to be moved in the direction opposite to direction A or B, the operating shaft 27 is inserted in the outer hole 16 of the mounting seat 15, the pawl member 18 is placed in the recess 181 of the spacer board 14 in such a manner that the upward flange 20 is directed toward the forming face 14*b* of the spacer board 14, and the edge tooth 30 of the pawl member 28 is arranged to engage with the teeth 19 of the rack member, as shown in FIG. 7. In this situation, the tooth 32 of the pawl 31 engages the rack member. When the lever is turned down, i.e. clockwise, from the upward position as shown, the eccentric member 34 will cause the pawl member 28 to move slightly forward or to the right in FIG. 7, thereby moving forward the rack member. When the lever turns counter-clockwise, the pawl member 28 moves rearwardly and engages with a next tooth of the rack member. By turning upward and downward the lever 26, the rack member 18 can be moved in a direction shown by arrow 50 to cause the spacer board 14 and the form board 13 to move to their molding positions. The tooth 32 of the pawl 31 prevents the backward movement of the rack member when the lever is operated.

When the spacer board 14 is to be moved in the direction A or B, the shaft 27 is inserted in the hole 17 of the mounting seat 15, and the position of the rack member 18 is changed so as to place the flange 20 away from the forming face 14*b*. In this situation, tooth 29 of the pawl member 28 and tooth 33 of the pawl 31 engage with the rack member 18 as shown in FIG. 8. By operating the lever 26, the rack member 18 can be moved in a direction 51 opposite to direction 50 to release the spacer board 14 or the form board 13 from the formed concrete structure. The movement of the rack member 18 stops when the flange 20 of the rack 18 contacts the projection 15*a* of the mounting seat 15.

Figure 9:
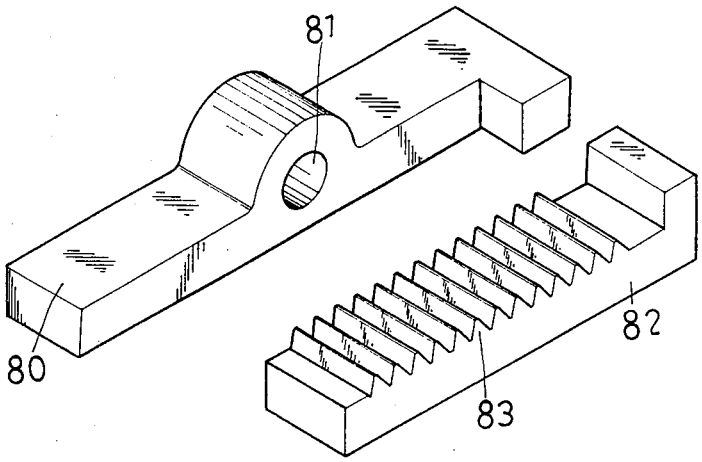
FIG. 9 shows another example of the rack member and the mounting seat of the invention.

FIG. 9 shows an alternative mounting seat 80 and an alternative rack member 82 which can be used in the present invention. The mounting seat 80 includes a single mounting hole 81 into which the shaft 27 can be inserted for moving the rack member in two directions. The rack member 82 is received removably in the recess 181 of the base member 14*c* so that the rack member 82 can be detached from the base member 14*c* to reverse its orientation. Since a single hole is provided on the mounting seat 80, the length of the rack member 82 must be greater than that of the rack member 18.

While the teeth of the rack members 18 and 82 are arranged such that their positions must be changed to be able to engage with the teeth 29 and 30 of the pawl arm 28 so as to move the rack members 18 and 82 in two directions, i.e. to a molding position and to a released position, the teeth of the rack member or the pawl used in the present invention may be arranged such that they are operative without changing the position of the rack member.

It can be appreciated that the form assembly according to the invention can be operated manually to move to a molding position or a position released from the molded concrete structure, and that the simultaneous operations of the two operating means of each form board 12 or 13 can move the form board 12 or 13 relative to the adjacent spacer boards 14.

With the invention thus explained, it is apparent that various modifications and variations can be made without departing from the scope of the present invention. It is therefore intended that the invention be limited only as indicated in the appended claims.

I claim:

1. A molding device comprising:

(a) two vertical component form boards (12, 13) each having a forming face and a base support (12*c*, 13*c*) extending horizontally at the bottom of each of said component form boards, each base support having a joint end face (12*a*, 13*a*) forming an acute angle with said forming face and a substantially horizontal top support face adjacent to said end face;

(b) a spacer board (14) disposed between said component form boards and having a vertical forming face and a base support (14*c*) extending horizontally from the bottom of said spacer board, said base support of said spacer board having two diverging joint end faces (14*a*) abutting with and releasably connected to said joint end faces of said component boards and two substantially horizontal top support faces adjacent to said diverging joint end faces;

(c) means (21, 22, 23) for releasably connecting said form boards to said spacer board; and (d) a force imparting, sliding movement mechanism operably associated with said horizontal support face of each of said component boards and said horizontal support face of said spacer board adjacent said support face of each of said component boards, said mechanism including a rack member (18) mounted on one of said adjacent support faces, said rack member having a thick plate member having a top surface provided with rack teeth (19), said one support face having a recess (181) for removably accommodating said thick plate member, said mechanism further including a mounting seat (15) fixed to the other one of said adjacent support faces and having at least one mounting hole (16, 17), a horizontal shaft (27) removably insertable into said mounting hole, a lever (26) connected to said shaft for turning said shaft, an eccentric member (34) fixed to said shaft, and a pawl member (28) having one end rotatably sleeved around said eccentric member and an opposite free end to engage with said rack teeth, said pawl member being capable of swinging freely.

2. A molding device as claimed in claim 1, wherein said mounting seat includes two mounting holes (16, 17) and said shaft can be interchangeably inserted in a selected one of said mounting holes.

3. A molding device as claimed in claim 1, wherein said free end of said pawl member is provided with two opposite edge teeth (29, 30), either of which can engage with said rack teeth.

4. A molding device as claimed in claim 1, wherein said mechanism further including a second pawl member (31) mounted rotatably on said shaft adjacent to said first pawl member.

5. A force imparting, sliding movement mechanism for effecting relative horizontal movement between two adjacent vertical boards (12, 13, 14) each having a coplanar concrete forming face and a base support (**12*c*; 13*c*, 14*c*) extending horizontally at the bottom of each of said boards, said base supports individually having abutting joint end faces (12*a*, 14*a*) forming complementary angles with said forming faces and substantially horizontal support faces adjacent to said end faces, said joint end faces of said base supports being releasably connected to one another, wherein said movement mechanism comprises: a rack member (18) mounted on one of said support faces, said rack member having a thick plate member which has a top surface provided with rack teeth (19), said one support face having a recess (181) for removably accommodating said thick plate member, said movement mechanism further including a mounting seat (15) fixed to the other one of said support faces and having at least one mounting hole (16, 17), a horizontal shaft (27) removably insertable into said mounting hole, a lever (26) connected to said shaft for turning said shaft, an eccentric member (334) fixed to said shaft, and a pawl member (28**) having one end rotatably sleeved around said eccentric member and an opposite free end to engage with said rack teeth, said pawl member being capable of swinging freely.

6. A mechanism as claimed in claim 5, wherein one of said vertical boards comprises a first board unit (13) and a second, wedge-shaped board unit (14) removably coupled (21, 22, 23) thereto at an acute angle to said forming faces.

* * * * *